US006647832B2

(12) United States Patent
Hu

(10) Patent No.: US 6,647,832 B2
(45) Date of Patent: Nov. 18, 2003

(54) WRENCH HAVING TWO RIGID SUPPORTING AREAS FOR A PAWL

(76) Inventor: Bobby Hu, P.O. Box 63-247, Taichung (TW)

( * ) Notice: Subject to any disclaimer, the term of this patent is extended or adjusted under 35 U.S.C. 154(b) by 0 days.

(21) Appl. No.: 09/916,796

(22) Filed: Jul. 27, 2001

(65) Prior Publication Data

US 2003/0019335 A1 Jan. 30, 2003

(51) Int. Cl.[7] ..... B25B 13/46
(52) U.S. Cl. ..... 81/63.2; 192/43.1; 192/43.2
(58) Field of Search ..... 81/60–63.2, 58; 192/43.1, 43.2

(56) References Cited

U.S. PATENT DOCUMENTS

| | | | |
|---|---|---|---|
| 15,482 | A | 8/1856 | Gilman |
| 810,599 | A | 1/1906 | Ansorge |
| 841,686 | A | 1/1907 | Hatfield |
| 893,097 | A | 7/1908 | Reams |
| 915,446 | A | 3/1909 | Kearnes |
| 1,033,358 | A | 7/1912 | Turner |
| 1,194,471 | A | 8/1916 | Boosinger |
| 1,261,092 | A | 4/1918 | Allen |
| 1,382,492 | A | 6/1921 | Evans |
| 1,426,127 | A | 8/1922 | Tuttle |
| 1,614,039 | A | 1/1927 | Mandl |
| 1,957,462 | A | 5/1934 | Kress |
| 2,193,984 | A | 3/1940 | Rhinevault |
| 2,201,705 | A | 5/1940 | Stone |
| 2,201,827 | A | 5/1940 | Froeschi et al. |
| 2,317,461 | A | 4/1943 | Jackson |
| 2,542,241 | A | 2/1951 | Fors |
| 2,657,604 | A | 11/1953 | Rueb |
| 2,701,977 | A | 2/1955 | Stone |
| 2,764,048 | A | 9/1956 | Thompson |
| 2,769,360 | A | 11/1956 | Cottrell et al. |
| 2,800,821 | A | 7/1957 | Fruscella |
| 2,891,434 | A | 6/1959 | Lozensky |
| 2,957,377 | A | 10/1960 | Hare |
| 2,978,081 | A | 4/1961 | Lundin |
| 3,019,682 | A | 2/1962 | Hare |
| 3,250,157 | A | 5/1966 | Badger |
| 3,265,171 | A | 8/1966 | Kilness |
| 3,337,014 | A | 8/1967 | Sandrick |
| 3,393,587 | A | 7/1968 | Jolliff et al. |
| 3,393,780 | A | 7/1968 | Kilness |
| 3,436,992 | A | 4/1969 | Over et al. |
| 3,577,816 | A | 5/1971 | Alexander et al. |
| 3,713,356 | A | 1/1973 | Knudsen |
| 3,742,788 | A | 7/1973 | Priest |
| 3,838,614 | A | 10/1974 | O'Donnell |
| 3,908,487 | A | 9/1975 | Plaw |
| 4,070,932 | A | 1/1978 | Jeannotte |
| 4,111,077 | A | 9/1978 | Cummings et al. |
| 4,128,025 | A | 12/1978 | Main et al. |
| 4,274,311 | A | 6/1981 | Ebert |
| 4,277,989 | A | 7/1981 | Tracy |
| 4,277,990 | A | 7/1981 | Hall |
| 4,308,768 | A | 1/1982 | Wagner |
| 4,308,769 | A | 1/1982 | Rantanen |
| 4,328,720 | A | 5/1982 | Shiel |

(List continued on next page.)

FOREIGN PATENT DOCUMENTS

| | | |
|---|---|---|
| DE | 921198 | 7/1949 |
| FR | 498276 | 1/1920 |
| GB | 1559093 | 1/1980 |
| GB | 2135226 | 8/1984 |

*Primary Examiner*—James G. Smith
(74) *Attorney, Agent, or Firm*—Alan D. Kamrath; Rider Bennett LLP

(57) ABSTRACT

A wrench invention includes a handle having a cavity defined by a wall. A head extends from the handle and includes a compartment that is communicated with the cavity. A drive member is rotatably received in the compartment of the head and includes a plurality of teeth on an outer periphery thereof. A pawl is received in the cavity of the handle and engaged with the teeth of the drive member. The pawl is supported by two fixed rigid supporting areas when in an operative position for ratcheting operation.

18 Claims, 13 Drawing Sheets

U.S. PATENT DOCUMENTS 4,336,728 A 6/1982 Deibert
4,406,186 A 9/1983 Gummow
4,420,995 A 12/1983 Roberts
4,485,700 A 12/1984 Colvin
4,488,460 A 12/1984 Ballone et al.
4,520,697 A 6/1985 Moetteli
4,631,988 A 12/1986 Colvin
4,662,251 A 5/1987 Kohal
4,709,600 A 12/1987 Mierbach et al.
4,722,252 A 2/1988 Fulcher et al.
4,722,253 A 2/1988 Chow
4,762,033 A 8/1988 Chow
4,770,072 A 9/1988 Neuhaus
4,796,492 A 1/1989 Liou
4,807,500 A 2/1989 Main
4,862,775 A 9/1989 Chow
4,869,138 A 9/1989 Farris
4,903,554 A 2/1990 Colvin
4,934,220 A 6/1990 Slusar et al.
4,986,147 A 1/1991 Cooper
4,991,468 A 2/1991 Lee
5,012,705 A 5/1991 Chow
5,076,121 A 12/1991 Fosella
5,144,869 A 9/1992 Chow
5,157,994 A 10/1992 Krivec
5,178,047 A 1/1993 Arnold et al.
5,199,330 A 4/1993 Arnold et al.
5,199,335 A 4/1993 Arnold et al.
5,230,262 A 7/1993 Ahlund et al.
5,231,903 A 8/1993 Bockman, Jr.
5,233,891 A 8/1993 Arnold et al.
5,271,300 A 12/1993 Zurbuchen et al.
5,295,422 A 3/1994 Chow
5,392,672 A 2/1995 Larson et al.
5,425,291 A 6/1995 Chang
5,467,672 A 11/1995 Ashby
5,477,757 A 12/1995 Maresh
5,495,783 A 3/1996 Slusar et al.
5,499,560 A 3/1996 Aeschliman
5,501,124 A 3/1996 Ashby
5,509,333 A 4/1996 Rion
5,533,427 A 7/1996 Chow
5,557,994 A 9/1996 Nakayama
5,582,081 A 12/1996 Lin
5,595,095 A 1/1997 Hillinger
5,626,061 A 5/1997 Whitley
5,626,062 A 5/1997 Colvin
5,636,557 A 6/1997 Ma
5,709,137 A 1/1998 Blacklock
5,782,147 A 7/1998 Chaconas et al.
5,794,496 A 8/1998 Arnold
5,829,326 A 11/1998 Richner
5,857,390 A 1/1999 Whiteford
5,873,286 A 2/1999 Van Lenten
5,884,538 A 3/1999 Van Lenten
5,901,620 A 5/1999 Arnold
5,910,197 A 6/1999 Chaconas
5,911,798 A 6/1999 Arnold
5,913,954 A 6/1999 Arnold et al.
5,927,158 A 7/1999 Lin
5,946,987 A 9/1999 Wei
5,946,989 A 9/1999 Wei
5,957,009 A 9/1999 McCann
5,964,129 A 10/1999 Shiao
5,970,552 A 10/1999 Kwiecien et al.
5,979,274 A 11/1999 Hsieh
5,996,453 A 12/1999 Blacklock
6,000,302 A 12/1999 Chiang
6,006,631 A 12/1999 Miner et al.
6,044,731 A 4/2000 Hsieh
6,065,374 A 5/2000 Taggart
6,134,990 A 10/2000 Ling et al.
6,134,991 A 10/2000 Chaconas
D433,896 S 11/2000 Wei
6,148,695 A 11/2000 Hu
6,152,826 A 11/2000 Profeta et al.
6,161,454 A 12/2000 Chaconas
6,164,167 A 12/2000 Chen
6,205,889 B1 3/2001 Hsieh
6,216,563 B1 4/2001 Hsieh
6,216,567 B1 4/2001 Hu
6,220,123 B1 4/2001 Chen
6,230,591 B1 5/2001 Ling et al.
6,240,813 B1 6/2001 Hyatt
6,257,096 B1 7/2001 Ling
6,260,448 B1 7/2001 Chaconas
6,263,767 B1 7/2001 Hu
6,282,991 B1 9/2001 Hu
6,282,992 B1 9/2001 Hu
6,282,993 B1 9/2001 Forman et al.
6,301,998 B1 10/2001 Hu
6,431,031 B1 8/2002 Hu
6,435,062 B1 * 8/2002 McCann ..... 81/63
6,435,063 B1 * 8/2002 Chen ..... 81/63.2
2001/0035074 A1 11/2001 Hu
2002/0017169 A1 2/2002 Hu
2002/0023519 A1 2/2002 Hu
2002/0023520 A1 2/2002 Hu
2002/0026858 A1 3/2002 Hu
2002/0088312 A1 * 7/2002 Ling et al.
2002/0112573 A1 * 8/2002 Hu ..... 81/63.2

* cited by examiner

WRENCH HAVING TWO RIGID SUPPORTING AREAS FOR A PAWL

BACKGROUND OF THE INVENTION

1. Field of the Invention

The present invention relates to a wrench having a pawl that is supported at two rigid areas.

2. Description of the Related Art

Ring spanners can be used in a limited space, e.g., an engine room of a vehicle, as they have been developed to overcome the problem of insufficient torque-bearing capacity. FIG. 12 of the drawings illustrates conventional ratchet type ring spanner comprising a handle 1, a gear wheel 4 rotatably mounted in a space of a head extended from an end of the handle 1, and a pawl 3 mounted in a cavity 2 of the handler 1. When the handle 1 is turned along a direction indicated by the arrow, an end of the pawl 3 bears against a side wall defining a portion of the cavity 2 and thus runs the gear wheel 4 for tightening/loosening a fastener. Namely, the pawl 3 is supported at a single supporting area. However, the inner lateral side of the pawl 3 facing away from the gear wheel 4 is not supported at all. Thus, the other lateral side 3*a* of the pawl 3 facing the gear wheel 4 pivots about a supporting point in the supporting area and slightly disengages from the teeth of the gear wheel 4 when a force exerting on the pawl 3 exceeds a predetermined value. As a result, a seesaw effect is incurred on the pawl 3 which leads to a poor engagement between the pawl 3 and the gear wheel 4; namely, the pawl 3 merely engages with the gear wheel 4 by the first three teeth, which tends to cause damage to these three teeth. Such a conventional ratchet type ring spanner of 17 mm size can bear a torque of about 28 kg-m. A solution to increase the torque-bearing capacity is to increase the size of the pawl, yet this contradicts the advantage of spanners for use in limited spaces, as the size of the head is also increased. FIG. 13 of the drawings illustrates another conventional wrench including a pawl 6 mounted in a cavity 8 of a handle (not labeled) for engaging with a gear wheel 7 in a head 5 extended from the handle. The pawl 6 includes a toothed side having two toothed portions 6*a* and 6*b* that have different centers of curvatures for meshing with the teeth of the gear wheel 7 by more teeth. The torque-bearing capacity of the pawl 6 is increased by about 30% when compared with the pawl of the wrench in FIG. 12 having the same size. However, the torque-bearing capacity of the pawl is still improvable without increasing the size of the pawl and the size of the head.

SUMMARY OF THE INVENTION

An object of the present invention is to provide a wrench having a pawl that is supported at two rigid areas, thereby providing a higher torque-bearing capacity without increasing the size of the pawl and the size of the head of the wrench.

Another object of the present invention is to provide a wrench including a pawl having a toothed side, wherein all of the teeth of the toothed side reliably mesh with the teeth of a drive member of the wrench, thereby providing a higher torque-bearing capacity.

A wrench in accordance with the present invention comprises a handle having a cavity defined by a wall. A head extends from the handle and comprises a compartment that is communicated with the cavity. A drive member is rotatably received in the compartment of the head and comprises a plurality of teeth on an outer periphery thereof. A pawl is received in the cavity of the handle and engaged with the teeth of the drive member. The pawl is supported by two fixed rigid supporting areas when in an operative position for ratcheting operation.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
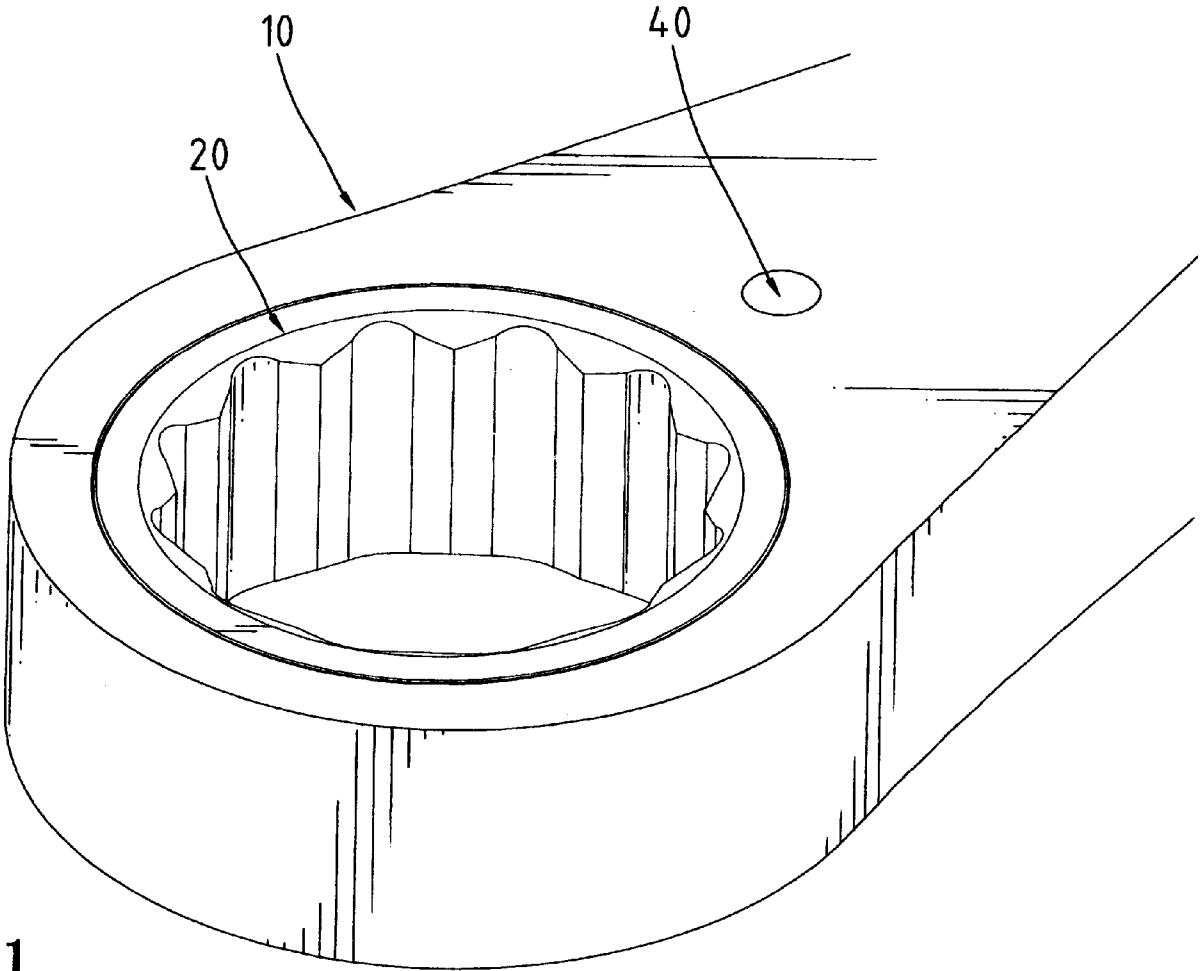
FIG. 1 is a perspective view of a portion of a first embodiment of a wrench in accordance with the present invention.
Figure 2:
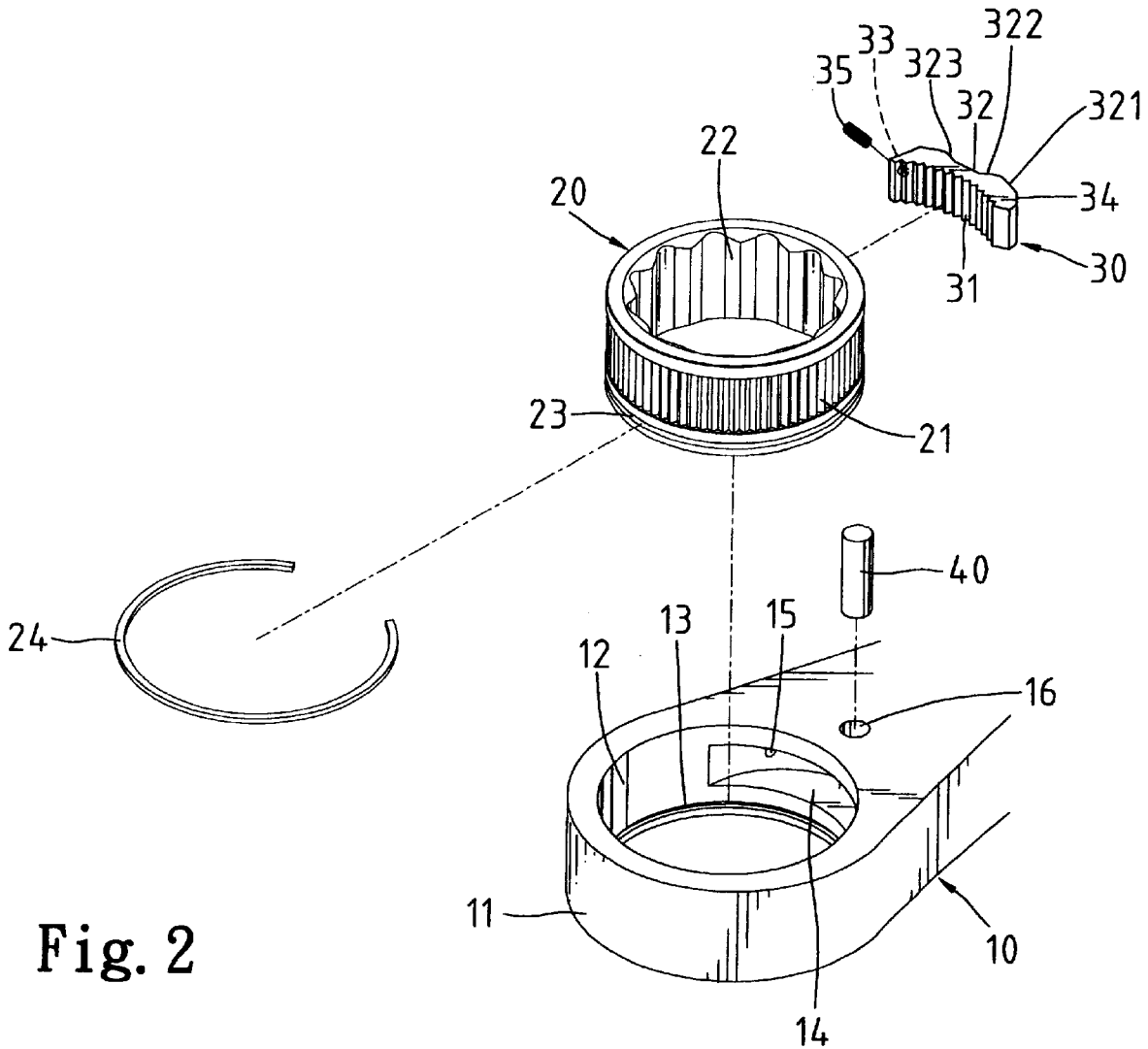
FIG. 2 is an exploded perspective view of the portion of the wrench in FIG. 1.
Figure 3:
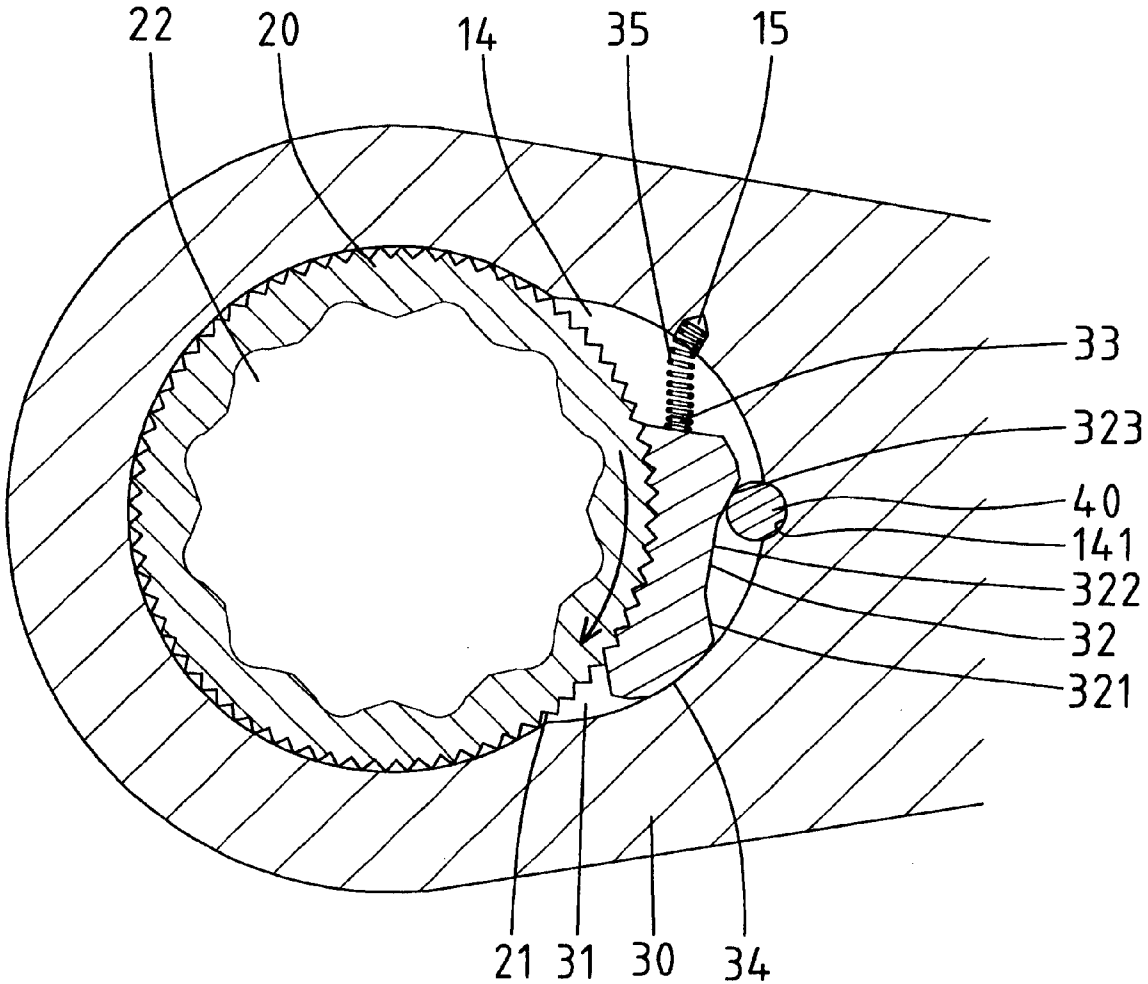
FIG. 3 is a sectional view of the portion of the wrench in FIG. 1.

Referring to FIGS. 1 through 11 and initially to FIGS. 1 and 3, a first embodiment of a wrench in accordance with the present invention generally includes a handle 10 comprising a cavity 14, a head 11 extending from the handle 10 and comprising a compartment 12 that is communicated with the cavity 14, a drive member 20 rotatably mounted in the compartment 12 of the head 11, and a pawl 30 slidably mounted in the cavity 14 of the handle 10.

An inner periphery defining the compartment 12 of the head 11 comprises an annular groove 13, and a C-clip 24 is received in the annular groove 13 and an annular groove 23 defined in a lower end of an outer periphery of the drive member 20, thereby rotatably mounting the drive member 20 in the compartment 12 of the head 11. In this embodiment, the drive member 20 is in the form of a gear wheel having a plurality of teeth 21 in an outer periphery thereof. The gear wheel 20 further comprises an inner polygonal periphery 22 for engaging with and thus driving a fastener, such as a nut or bolt head.

A receptacle 15 is defined in a wall defining a portion of the cavity 14 of the handle 10 for receiving an end of an elastic element 35. The other end of the elastic element 35 is attached to a peg 33 formed on an end of the pawl 30, thereby biasing the pawl 30 toward the gear wheel 20. The other end 34 of the pawl 30 bears against another wall portion defining the cavity 14 of the handle 10. The pawl 30 further comprises a toothed first side 31 facing the gear wheel 20 and a second side 32 facing away from the gear wheel 20. The second side 32 of the pawl 30 is preferably recessed and comprises a first end section 323 and a second end section 321. Preferably, a transition section 322 can be formed between the first end section 323 and the second end section 321.

A portion of the wall defining the cavity 14 and facing the gear wheel 20 comprises a positioning groove 141 for receiving a portion of a rigid pin 40. As illustrated in FIG. 3, another portion of the rigid pin 40 bears against the first end section 323. Thus, the pawl 30 is supported at two areas: the end 34 of the pawl 30 and the first end section 323. When the handle 10 is turned clockwise all the teeth of the toothed first side 31 of the pawl 30 mesh with the teeth of the gear wheel 20, as the wall defining the cavity 14 of the handle 10 and the rigid pin 40 provide two fixed rigid areas for supporting the pawl 30. Thus, a higher torque-bearing capacity is provided when compared with a conventional ratchet type ring spanner having a pawl of the same size, it was found that a 17-mm wrench in accordance with the present invention may bear a torque up to 60 kg-m. The drive member 20 rotates freely when the handle 10 is turned in a counterclockwise direction. The handle 10 may include a mounting hole 16 (FIG. 2) defined in a face thereof (e.g., the upper face) and aligned with the positioning groove 141 to allow easy installation of the rigid pin 40 into the positioning groove 141 from outside.

Figure 4:
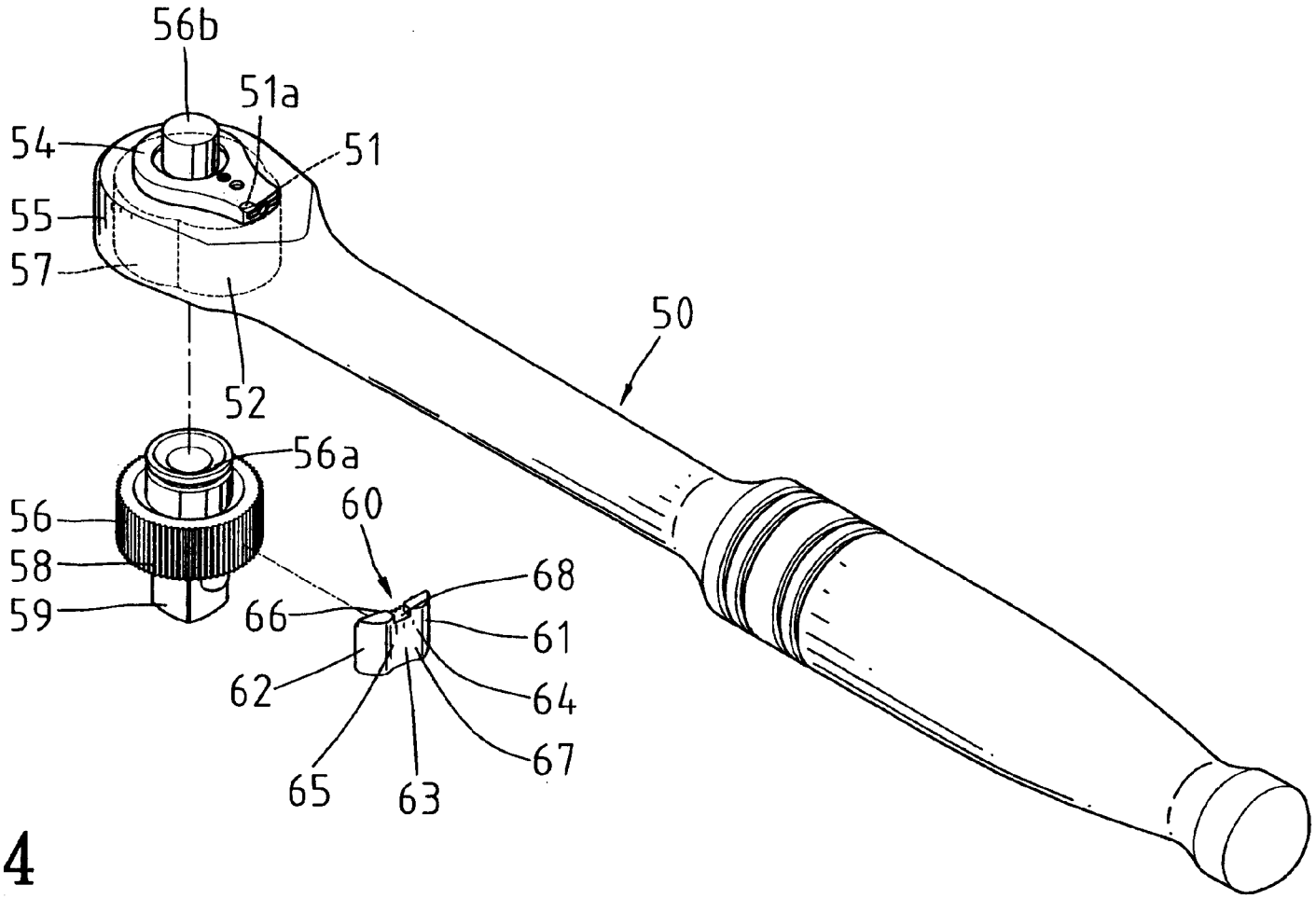
FIG. 4 is a perspective view of a portion of a second embodiment of the wrench in accordance with the present invention.
Figure 5:
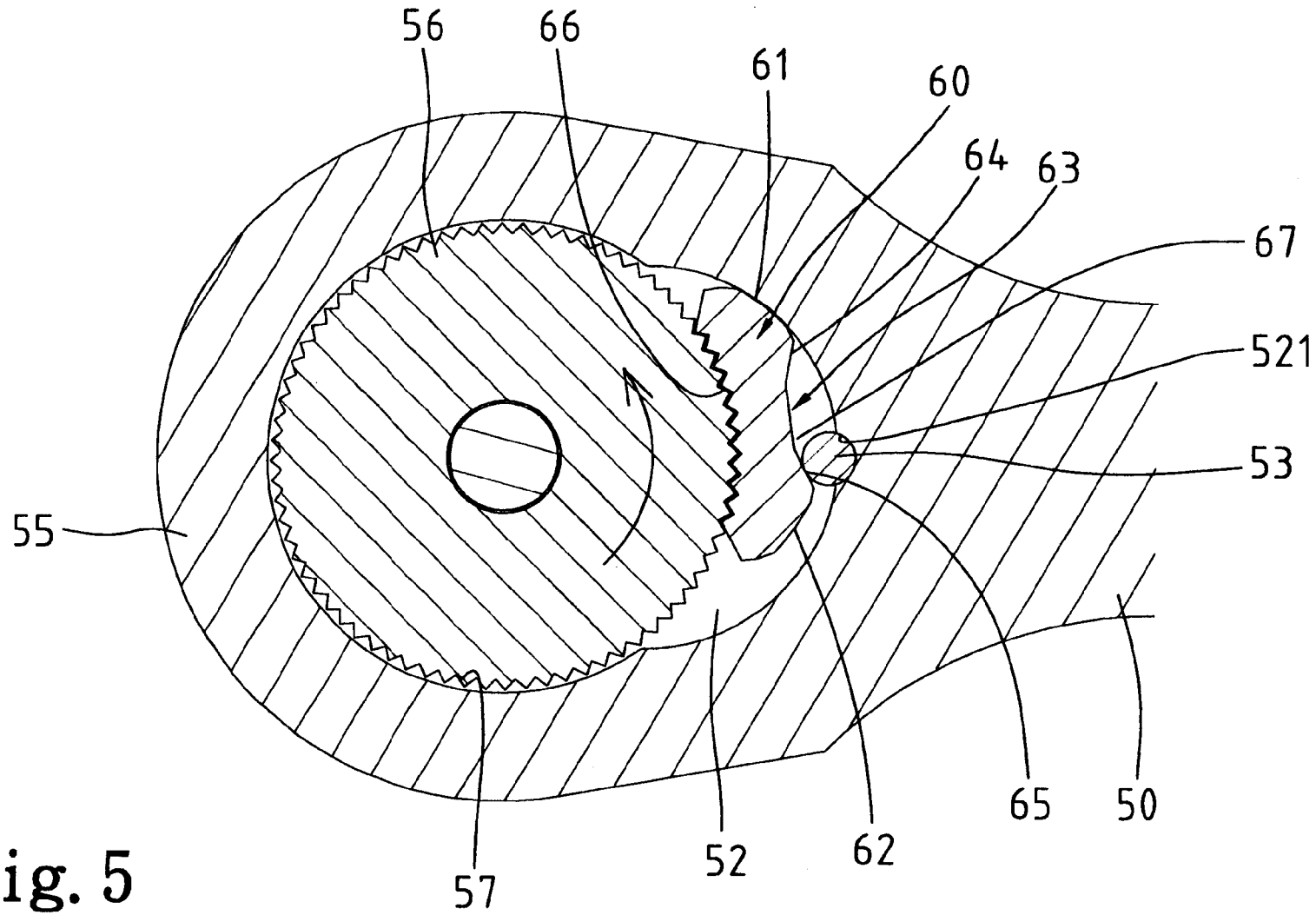
FIG. 5 is a sectional view of the portion of the wrench in FIG. 4.
Figure 6:
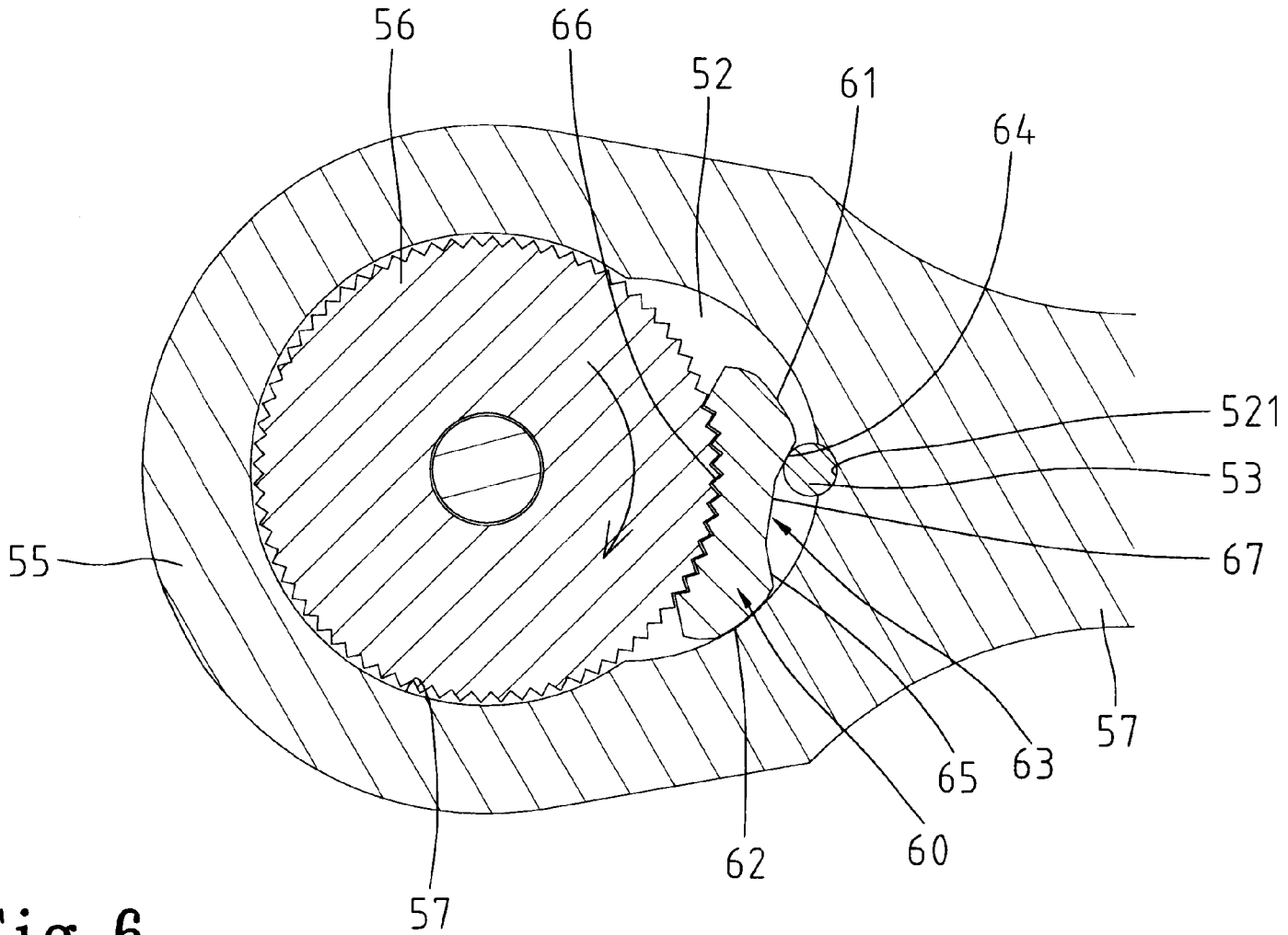
FIG. 6 is a sectional view similar to FIG. 5, wherein the pawl is moved to another position.

FIGS. 4 through 6 illustrate a second embodiment of the wrench in accordance with the present invention. In this embodiment, the wrench comprises a handle 50, a head 55 extending from an end of the handle 50 and comprising a compartment 57, a drive member 56 rotatably received in the compartment 57, and a pawl 60 slidably received in a cavity 52 defined in the end of the handle 50. In this embodiment, the drive member 56 includes a gear wheel 58 having a toothed outer periphery (not labeled), a drive column 59 extending downward from an underside of the gear wheel 58 for driving a socket (not shown), and an engaging column **56*a* extending from an upper side of the gear wheel 58 for engaging with a push member 56*b* around which an end 54 of a switch member 51** is mounted.

The pawl 60 comprises a first end 61, a second end 62, a toothed first side 66 facing the drive member 56, and a second side 63 facing away from the drive member 56. The second side 63 of the pawl 60 is recessed and comprises a first end section 64 that is adjacent to the first end 61 of the pawl 60 and a second end section 65 that is adjacent to the second end 62 of the pawl 60. Preferably, a transition section 67 is formed between the first end section 64 and the second end section 65. Each of the first end section 64 and the second end section 65 is an inclined face extending from an associated one of two ends of the transit section 67 along a plane at an acute angle with the transit section 67. The pawl 60 further comprises a notch 68 in an upper side thereof for engaging with a protrusion **51*a* of the switch member 51. Thus, the pawl 60 in the cavity 52 of the handle 50 can be moved between two operative positions upon manually moving the switch member 51. In addition, a portion of the wall defining the cavity 52 and facing the drive member 56 comprises a positioning groove 521 for receiving a portion of a rigid pin 53**.

When the pawl 60 is in an operative position shown in FIG. 5, the first end 61 of the pawl 60 bears against a portion of a wall defining the cavity 52 of the handle 50. In addition, another portion of the rigid pin 53 bears against the second end section 65 of the second side 63 of the pawl 60. Thus, the pawl 60 is supported at two areas: the first end 61 of the pawl 60 and the second end section 65 of the second side 63 of the pawl 60. When the handle 50 is turned counterclockwise, all of the teeth of the toothed first side 66 of the pawl 60 mesh with the teeth of the toothed outer periphery of the gear wheel 58. Thus, a higher torque-bearing capacity is provided when compared with a conventional wrench having a pawl of the same size. This is owing to the wall defining the cavity 52 of the handle 50 and the rigid pin 53 provide two fixed rigid areas for supporting the pawl 60.

When the pawl 60 is in another operative position shown in FIG. 6, the second end 62 of the pawl 60 bears against another portion of the wall defining the cavity 52 of the handle 50. In addition, another portion of the rigid pin 53 bears against the first end section 64 of the second side 63 of the pawl 60. Thus, the pawl 60 is supported at two areas: the second end 62 of the pawl 60 and the first end section 64 of the second side 63 of the pawl 60. When the handle 50 is turned clockwise, all of the teeth of the toothed first side 66 of the pawl 60 mesh with the teeth of the toothed outer periphery of the gear wheel 58. Thus, a wrench with improved torque-bearing capacity particularly useful in a limited space is provided. This is owing to the wall defining the cavity 52 of the handle 50 and the rigid pin 53 provide two fixed rigid areas for supporting the pawl 60.

Figure 7:
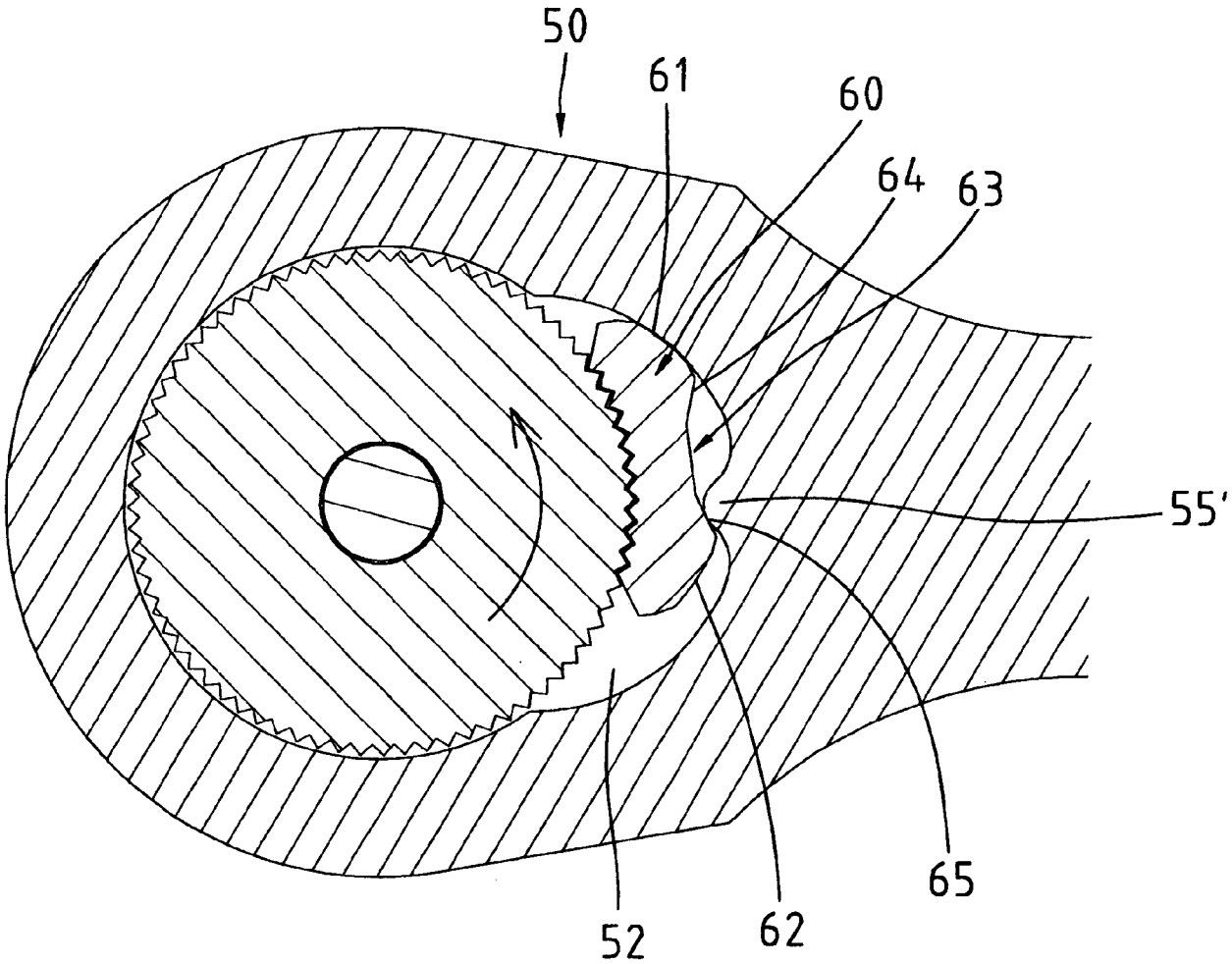
FIG. 7 is a sectional view similar to FIG. 5, illustrating a third embodiment of the wrench in accordance with the present invention.
Figure 8:
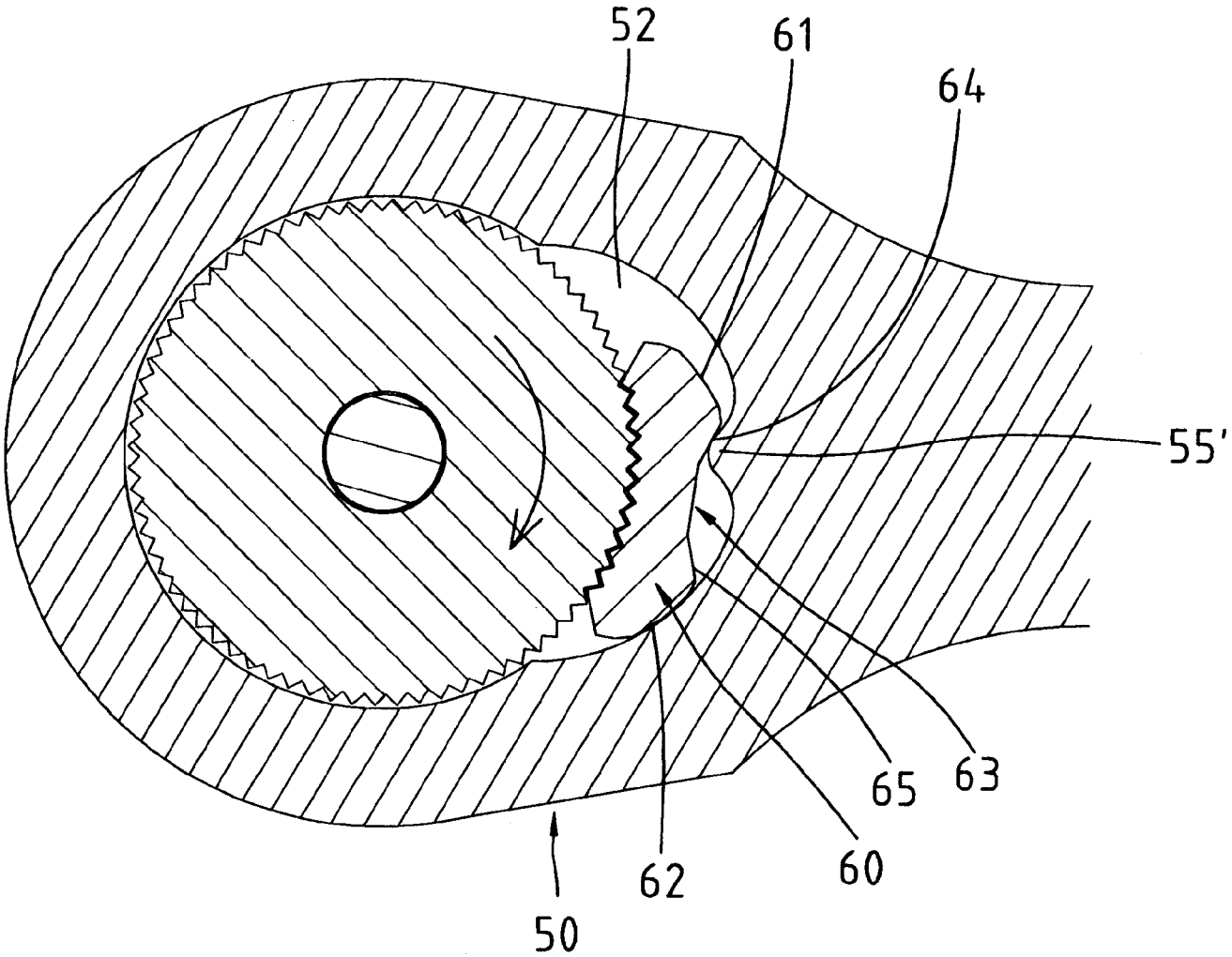
FIG. 8 is a sectional view similar to FIG. 7, wherein the pawl is moved to another position.

FIG. 7 illustrates a third embodiment that is modified from the second embodiment, wherein positioning groove 521 of the handle 50 is omitted, and the rigid pin 53 is replaced by a ridge 55' integrally formed on the wall defining the cavity 52. As illustrated in FIGS. 7 and 8, such a wrench is changeable in the ratcheting direction and has a higher torque-bearing capacity.

Figure 9:
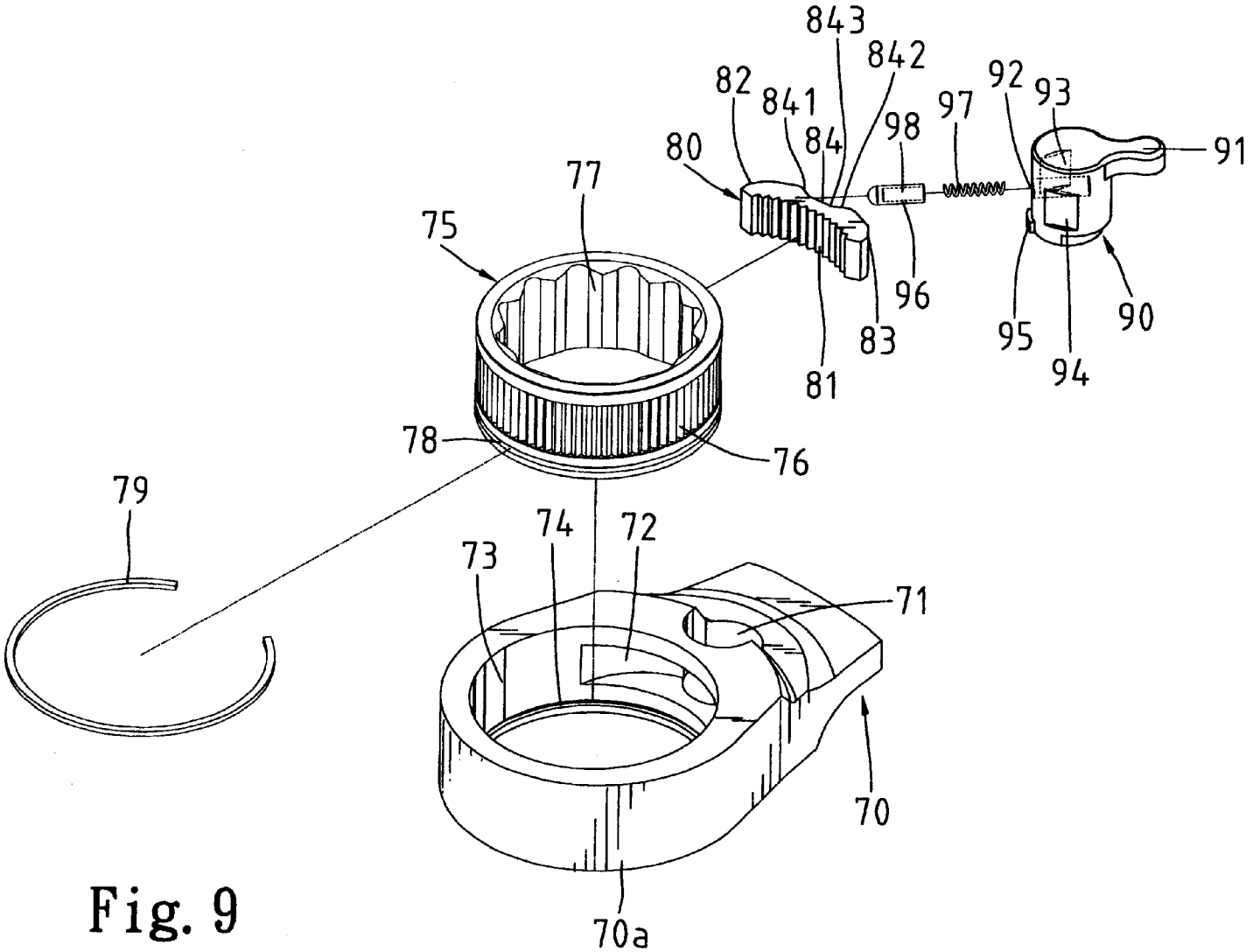
FIG. 9 is a perspective view of a portion of a fourth embodiment of the wrench in accordance with the present invention.
Figure 10:
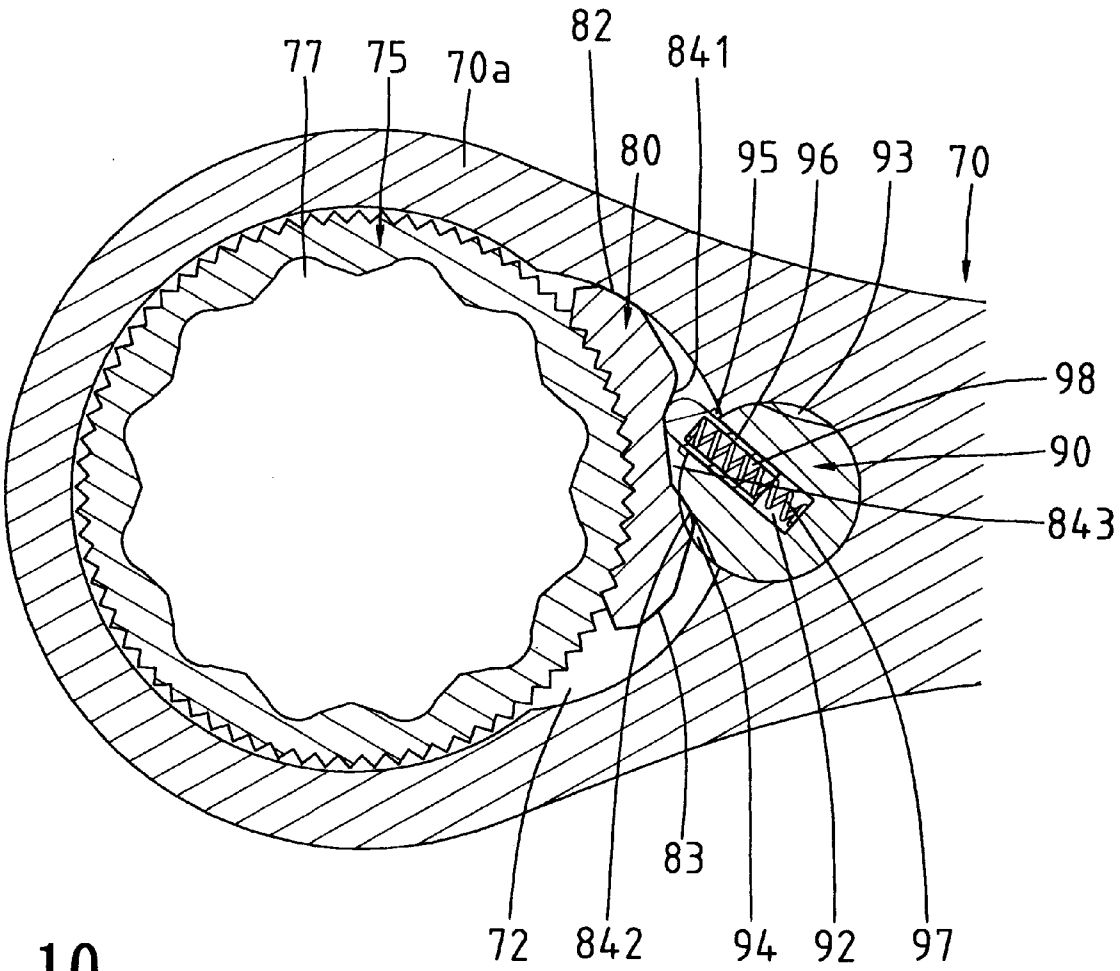
FIG. 10 is a sectional view of the portion of the wrench in FIG. 9.
Figure 11:
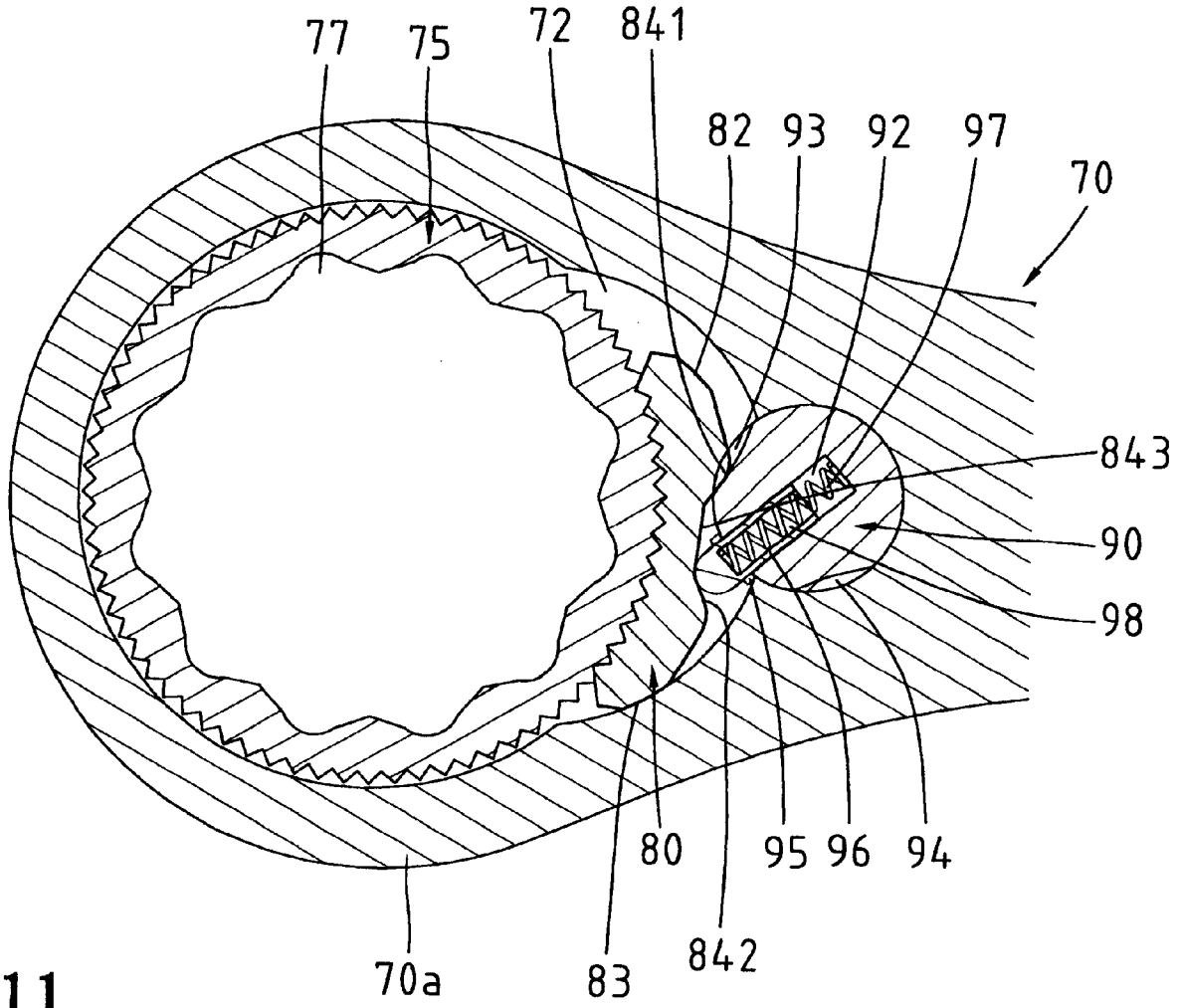
FIG. 11 is a sectional view similar to FIG. 10, wherein the pawl is moved to another position.

FIGS. 9 through 11 illustrate a fourth embodiment of the wrench in accordance with the present invention. In this embodiment, the wrench comprises a handle 70 comprising a cavity 72, a head **70*a* extending from an end of the handle 70 and comprising a compartment 73 that is communicated with the cavity 72, a drive member 75 rotatably mounted in the compartment 73 of the head 70*a*, a pawl 80 slidably mounted in the cavity 72 of the handle 70, and a switch member 90**.

An inner periphery defining the compartment 73 of the head **70*a* comprises an annular groove 74, and a C-clip 79 is received in the annular groove 74 and an annular groove 78 defined in a lower end of an outer periphery of the drive member 75, thereby rotatably mounting the drive member 75 in the compartment 73 of the head 70*a*. In this embodiment, the drive member 75 is in the form of a gear wheel having a plurality of teeth 76 in an outer periphery thereof. The gear wheel 75 further comprises an inner polygonal periphery 77** for engaging with and thus driving a fastener, such as a nut or bolt head.

The pawl 80 comprises a first end 82, a second end 83, a toothed first side 61 facing the gear wheel 75, and a second side 84 facing away from the gear wheel 75. The second side 84 of the pawl 80 is recessed and comprises a first end section 841 that is adjacent to the first end 82 of the pawl 80 and a second end section 842 that is adjacent to the second end 83 of the pawl 80. Preferably, a transition section 843 is formed between the first end section 841 and the second end section 842. Each of the first end section 841 and the second end section 842 is an inclined face extending from an associated one of two ends of the transit section 843 along a plane at an acute angle with the transit section 843.

The handle 70 comprises a positioning hole 71 extending inward from a face (e.g., the upper face) of the handle 70 and partially into the cavity 72 of the handle 70. The switch member 90 is rotatably received in the positioning hole 71. A manual piece 91 extends from the switch member 90 and locates outside the handle 70 for manual operation. As illustrated in FIGS. 9 and 10, the switch member 90 comprises a receptacle 92 for receiving an elastic element 97. A rigid pin 96 comprises a first end engaged in the recessed second side 84 of the pawl 80 and a second end to which an end of the elastic element 97 is attached. In this embodiment, a receptacle 98 is defined in the second end of the rigid pin 96 for receiving the end of the elastic element 97. The other end of the elastic element 97 is attached to an inner end wall defining the receptacle 92 of the switch member 90.

The switch member 90 further comprises a first supporting face 93 and a second supporting face 94 that is preferably angularly spaced from the first supporting face 93. In addition, the switch member 90 comprises a stop 95 for reminding the user of the angular position of the switch member 90. As illustrated in FIGS. 10 and 11, the pawl 80 in the cavity 72 of the handle 70 can be moved between two operative positions upon manually moving the switch member 90.

When the pawl 80 is iii an operative position shown in FIG. 10, the first end 82 of the pawl 80 bears against a portion of a wall defining the cavity 72 of the handle 70. In addition, the second supporting face 94 of the switch member 90 bears against the second end section 842 of the second side 84 of the pawl 80. Thus, the pawl 80 is supported at two areas; the first end 82 of the pawl 80 arid the second end section 842 of the second side 84 of the pawl 80. When the handle 70 is turned counterclockwise, all of the teeth of the toothed first side 81 of the pawl 80 mesh with the teeth 76 of the gear wheel 75. Thus, a higher torque-bearing capacity is provided when compared with a conventional wrench having a pawl of the same size. This is owing to the wall defining the cavity 72 of the handle 70 and the second supporting face 94 of the switch member 90 provide two fixed rigid areas for supporting the pawl 80. The gear wheel 75 rotates freely when the handle 70 is turned in a clockwise direction.

When thc pawl 80 is in another operative position shown in FIG. 11, the second end 83 of the pawl 80 bears against another portion of the wall defining the cavity 72 of the handle 70. In addition, the first supporting face 93 of the switch member 90 is turned to a position bearing against the first end section 841 of the second side 84 of the pawl 80. Thus, the pawl 80 is supported at two areas; the second end 83 of the pawl 80 and the first end section 841 of the second side 84 of the pawl 80. When the handle 70 is turned clockwise, all of the teeth of the toothed first side 81 of the pawl 80 mesh with the teeth 76 of the gear wheel 75. The gear wheel 75 rotates freely when the handle 70 is turned in a counterclockwise direction. Thus, a reversible wrench with improved torque-bearing capacity particularly useful in a limited space is provided. This is owing to the wall defining the cavity 72 of the handle 70 and of the first supporting face 93 of the switch member 90 provide two fixed rigid areas for supporting the pawl 80.

During turning of the manual piece 91, one of two sides of the stop 95 will come in contact with the wall defining the cavity 72 of the handle 70, thereby reminding the user that the switch member 90 has reached its position for ratcheting operation.

Figure 12:
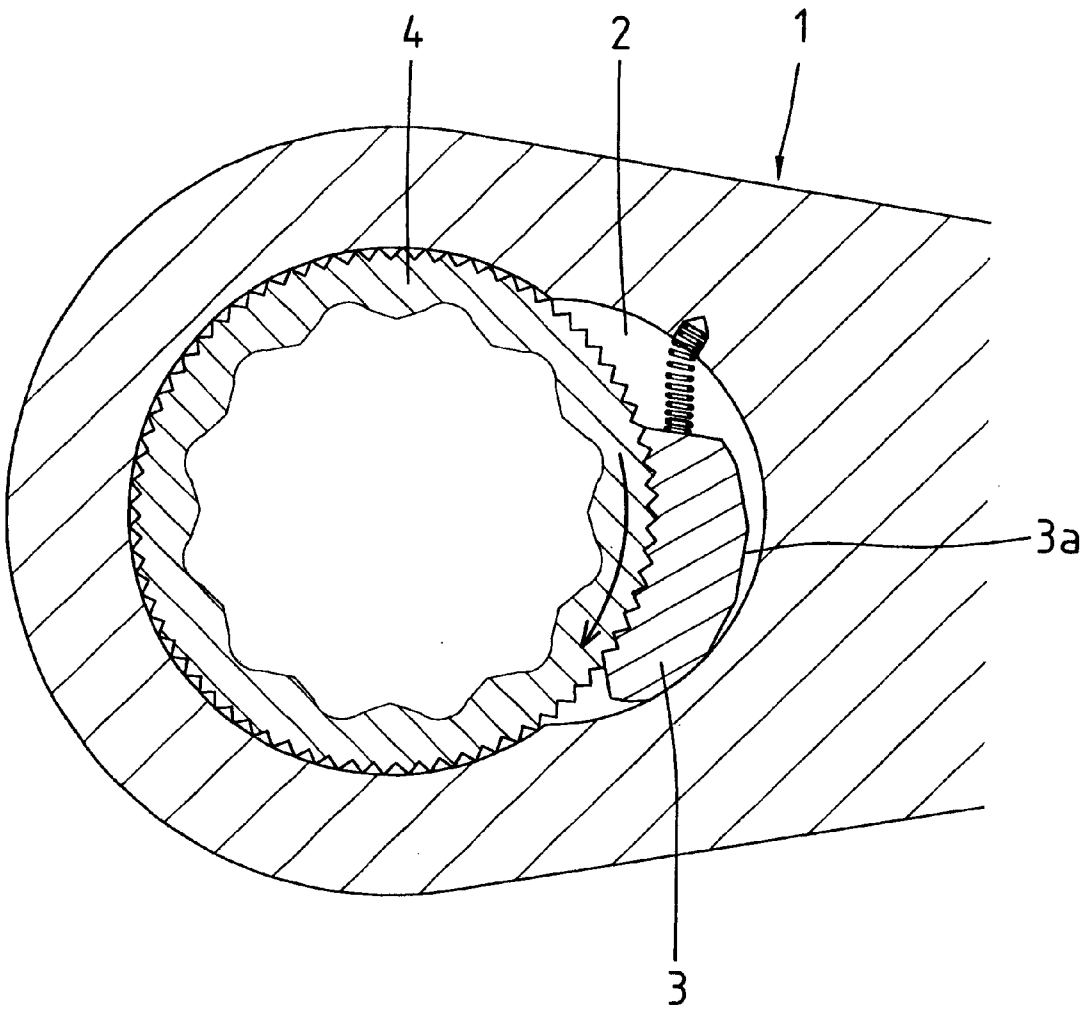
FIG. 12 is a sectional view of a portion of a conventional ratchet type ring spanner.
Figure 13:
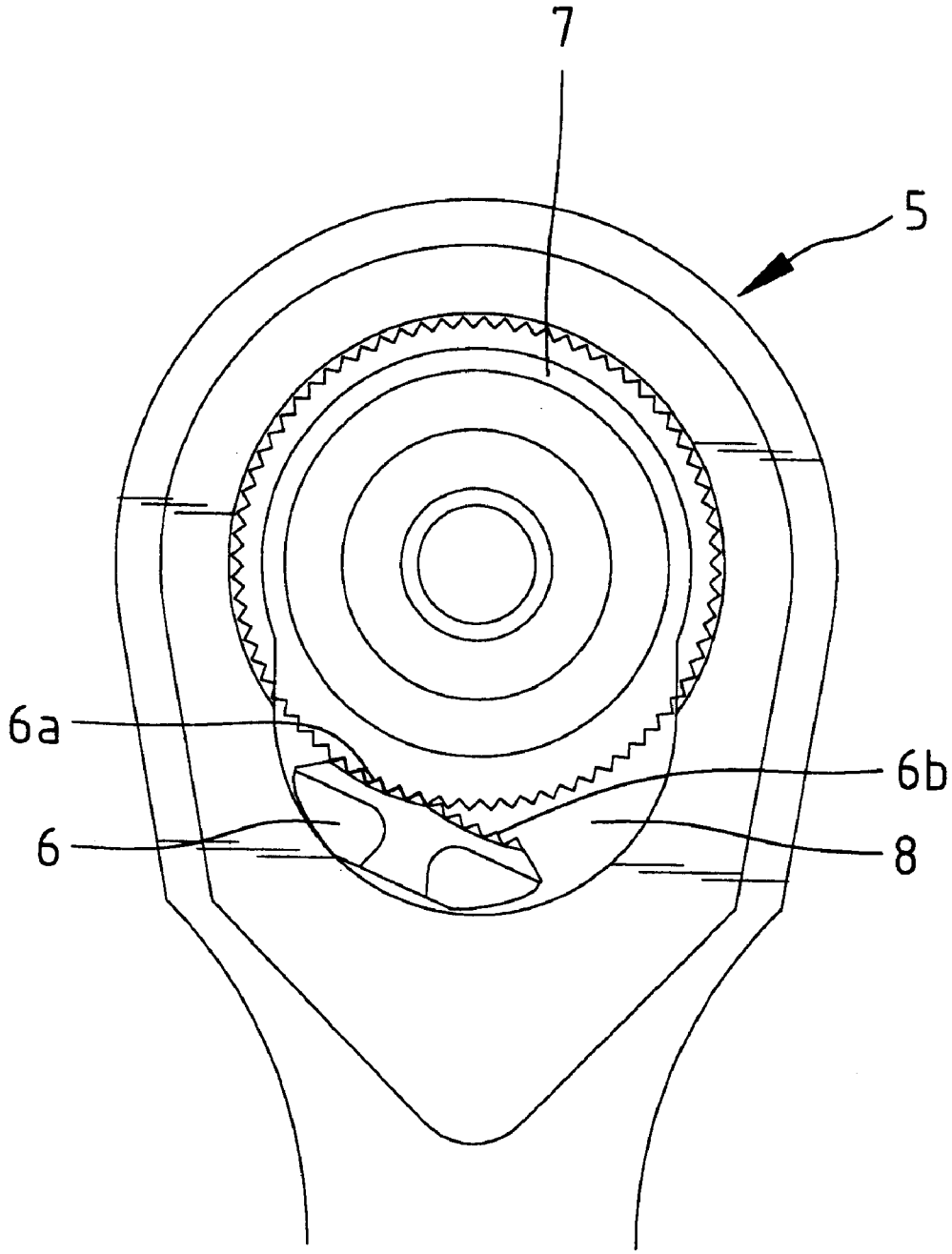
FIG. 13 is a sectional view of a portion of a conventional wrench.

According to the above description, it is appreciated that the wrench in accordance with the present invention provides two supporting areas for the pawl to thereby provide a higher torque-bearing capacity without increasing the size of the pawl or the size of the head. The drawback of the seesaw effect of the conventional wrench in FIG. 12 is avoided. All of the teeth of the pawl reliably mesh with the toothed outer periphery of the gear wheel to thereby prevent uneven distribution of force. In addition, the torque-bearing capacity of the pawl is increased by more than 200% when compared with the conventional ratchet type ring spanner in FIG. 12 and by more 180% when compared with the conventional wrench in FIG. 13. This allows production of the pawl from a less rigid material.

Although the invention has been explained in relation to its preferred embodiment, it is to be understood that many other possible modifications and variations can be made without departing from the scope of the invention as hereinafter claimed.

What is claimed is:

1. A wrench comprising:

a handle comprising a cavity defined by a wall;

a head extending from the handle and comprising a compartment that is communicated with the cavity;

a drive member rotatably received in the compartment of the head, the drive member comprising a plurality of teeth on an outer periphery thereof;

a pawl received in the cavity of the handle and engaged with the teeth of the drive member, wherein the pawl comprises a first end, a second end, a first side facing the teeth of the drive member, and a second side facing away from the teeth of the drive member, the first side of the pawl including a toothed portion for meshing with the teeth of the drive member, with the second side of the pawl being supported by two rigid supporting areas when in an operative position for ratcheting operation, with one of the first and second ends of the pawl bearing against a portion of the wall defining the cavity which provides one of the two rigid supporting areas, wherein the wall defining the cavity of the handle comprises a receptacle; and an elastic element including a first end securely mounted in the receptacle and a second end attached to the first end of the pawl, thereby biasing the second end of the pawl to bear against a portion of the wall defining the cavity of the handle, the portion of the wall born against by the second end of the pawl being one of the rigid supporting areas for the pawl.

2. The wrench as claimed in claim 1, wherein the wall defining the cavity of the handle comprises a positioning groove, further comprising a rigid pin partially received in the positioning groove, the rigid pin having a portion bearing against the second side of the pawl, thereby forming the other of the rigid supporting areas for the pawl.

3. The wrench as claimed in claim 2, wherein the handle comprises a mounting hole defined in a face thereof, the mounting hole being aligned with the positioning groove to allow insertion of the rigid pin into the positioning groove via the mounting hole.

4. The wrench as claimed in claim 2, wherein the second side of the pawl is recessed.

5. The wrench as claimed in claim 1, wherein the drive member is a gear wheel comprising an inner polygonal periphery for driving a fastener.

6. A wrench comprising:

a handle comprising a cavity defined by a wall;

a head extending from the handle and comprising a compartment that is communicated with the cavity;

a drive member rotatably received in the compartment of the head, the drive member comprising a plurality of teeth on an outer periphery thereof;

a pawl received in the cavity of the handle and engaged with the teeth of the drive member, wherein the pawl comprises a first end, a second end, a first side facing the teeth of the drive member, and a second side facing away from the teeth of the drive member, the first side of the pawl including a toothed portion for meshing with the teeth of the drive member, with the second side of the pawl being supported by two rigid supporting areas when in an operative position for ratcheting operation, with one of the first and second ends of the pawl bearing against a portion of the wall defining the cavity which provides one of the two rigid supporting areas, wherein the wall defining the cavity of the handle comprises a positioning groove; and a rigid pin partially received in the positioning groove, the rigid pin having a portion bearing against the second side of the pawl, thereby forming one of the rigid supporting areas for the pawl;

the second side of the pawl being recessed and comprising a first end section that is adjacent to the first end of the pawl and a second end section that is adjacent to the second end of the pawl;

the rigid pin bearing against the first end section of the pawl and the second end of the pawl bearing against a portion of the wall defining the cavity of the handle when the pawl is in a first operative position in the cavity corresponding a first ratcheting direction of the handle;

the rigid pin bearing against the second end section of the pawl and the first end of the pawl bearing against another portion of the wall defining the cavity of the handle when the pawl is in a second operative position in the cavity corresponding a second ratcheting direction of the handle that is opposite to the first ratcheting direction.

7. The wrench as claimed in claim 6, wherein the drive member comprises a gear wheel rotatably received in the compartment of the head, a drive column extending from a side of the gear wheel for engaging with a socket, further comprising a switch member having a protrusion, the pawl further comprising a notch in an upper side thereof for engaging with the protrusion of the switch member, thereby allowing movement of the pawl between the first operative position and the second operative position by means of moving the switch member.

8. The wrench as claimed in claim 7, wherein the pawl further comprises a transit section between the first end section and the second end section, the transit section having two ends, each of the first end section and the second end section being an inclined face extending from an associated one of the ends of the transit section along a plane at an acute angle with the transit section.

9. A wrench comprising:

a handle comprising a cavity defined by a wall, the wall defining the cavity providing two rigid supporting areas, wherein the wall defining the cavity of the handle comprises a ridge that forms one of the rigid supporting areas for the pawl;

a head extending from the handle and comprising a compartment that is communicated with the cavity;

a drive member rotatably received in the compartment of the head, the drive member comprising a plurality of teeth on an outer periphery thereof; and a pawl received in the cavity of the handle and engaged with the teeth of the drive member, the pawl being supported by the rigid supporting areas when in an operative position for ratcheting operation, wherein the pawl comprises a first end, a second end, a first side facing the teeth of the drive member, and a second side facing away from the teeth of the drive member, the first side of the pawl including a toothed portion for meshing with the teeth of the drive member, the second side of the pawl being recessed and comprising a first end section that is adjacent to thc first end of the pawl and a second end section that is adjacent to the second end of the pawl;

the ridge bearing against the first end section of the pawl and the second end of the pawl bearing against a portion of the wall defining the cavity of the handler when the pawl is in a first operative position in the cavity corresponding a first ratcheting direction of the handle;

the ridge bearing against the second end section of the pawl and the first end of the pawl bearing against another portion of the wall defining the cavity of the handle when the pawl is in a second operative position in the cavity corresponding a second ratcheting direction of the handle that is opposite to the first ratcheting direction.

10. The wrench as claimed in claim 9, wherein the drive member comprises a gear wheel rotatably received in the compartment of the head, a drive column extending from a side of the gear wheel for engaging with a socket, further comprising a switch member having a protrusion, the pawl further comprising a notch in an upper side thereof for engaging with the protrusion of the switch member, thereby allowing movement of the pawl between the first operative position and the second operative position by means of moving the switch member.

11. The wrench as claimed in claim 10, wherein the pawl further comprises a transit section between the first end section and the second end section, the transit section having two ends, each of the first end section and the second end section being an inclined face extending from an associated one of the ends of the transit section along a plane at an acute angle with the transit section.

12. A wrench comprising:

a handle comprising a cavity defined by a wall;

a head extending from the handle and comprising a compartment that is communicated with the cavity;

a drive member rotatably received in the compartment of the head, the drive member comprising a plurality of teeth on an outer periphery thereof;

a pawl received in the cavity of the handle and engaged with the teeth of the drive member, wherein the pawl comprises a first end, a second end, a first side facing the teeth of the drive member, and a second side facing away from the teeth of the drive member, the first side of the pawl including a toothed portion for meshing with the teeth of the drive member, with the second side of the pawl being supported by two rigid supporting areas when in an operative position for ratcheting operation, with one of the first and second ends of the pawl bearing against a portion of the wall defining the cavity which provides one of the two rigid supporting areas, wherein the handle further comprises a positioning hole extending from a side thereof and partially into the cavity of the handle; and a switch member rotatably received in the cavity, the switch member further comprising a first supporting face and a second supporting face that is angularly spaced from the first supporting face;

the second side of the pawl being recessed and comprising a first end section that is adjacent to the first end of the pawl and a second end section that is adjacent to the second end of the pawl;

a rigid pin comprising a first end slidably received in the second side of the pawl and a second end;

an elastic element mounted between the switch member and the second end of the rigid pin for biasing the first end of the rigid pin to bear against one of the first end section and the second end section of the pawl;

the pawl being movable between a first operative position and a second operative section upon rotating the switch member;

the first end of the rigid pin bearing against the first end section of the pawl and the second end of the pawl bearing against a portion of the wall defining the cavity of the handle when the pawl is in the first operative position in the cavity corresponding a first ratcheting direction of the handle;

the first end of the rigid pin bearing against the second end section of the pawl and the first end of the pawl bearing against another portion of the wall defining the cavity of the handle when the pawl is in the second operative position in the cavity corresponding a second ratcheting direction of the handle that is opposite to the first ratcheting direction of the handle.

13. The wrench as claimed in claim 12, wherein the switch member comprises a receptacle for receiving an end of the elastic element.

14. The wrench as claimed in claim 10, wherein the switch member further comprises a stop having two sides, each of the sides of the stop being selectively stopped by an associated portion of the wall defining the cavity of the handle during rotation the switch member for moving the pawl, thereby indicating completion of a change in the ratcheting direction of the handle.

15. The wrench as claimed in claim 12, further comprising a manual piece extending from the switch member and locating outside the handle for manual operation.

16. The wrench as claimed in claim 14, further comprising a manual piece extending from the switch member and locating outside the handle for manual operation.

17. The wrench as claimed in claim 12, wherein the pawl further comprises a transit section between the first end section and the second end section, the transit section having two ends, each of the first end section and the second end section being an inclined face extending from an associated one of the ends of the transit section along a plane at an acute angle with the transit section.

18. The wrench as claimed in claim 12, wherein the drive member is a gear wheel comprising an inner polygonal periphery for driving a fastener.

* * * * *